US006581719B2

(12) United States Patent
Adamson

(10) Patent No.: US 6,581,719 B2
(45) Date of Patent: Jun. 24, 2003

(54) WAVE SHAPING SOUND CHAMBER

(76) Inventor: Alan Brock Adamson, 2364 Passmore Ave., Scarborough, Ontario (CA), M1X 1P8

( * ) Notice: Subject to any disclaimer, the term of this patent is extended or adjusted under 35 U.S.C. 154(b) by 0 days.

(21) Appl. No.: 09/915,273

(22) Filed: Jul. 27, 2001

(65) Prior Publication Data

US 2002/0014368 A1 Feb. 7, 2002

Related U.S. Application Data

(60) Provisional application No. 60/222,613, filed on Aug. 2, 2000.

(51) Int. Cl.[7] ..... G10K 11/00

(52) U.S. Cl. ..... 181/182; 181/152

(58) Field of Search ..... 181/152, 153, 181/155, 159, 185, 187, 188, 191, 182, 192, 195

(56) References Cited

U.S. PATENT DOCUMENTS

| | | | | | |
|---|---|---|---|---|---|
| 4,091,891 | A | * | 5/1978 | Hino et al. | 181/185 |
| 6,016,353 | A | * | 1/2000 | Gunness | 181/145 |
| 6,078,676 | A | * | 6/2000 | Takenaka | 181/145 |
| 6,112,847 | A | * | 9/2000 | Lehman | 181/152 |

* cited by examiner

*Primary Examiner*—Kim Lockett
(74) *Attorney, Agent, or Firm*—Dowell & Dowell, P.C.

(57) ABSTRACT

A loudspeaker system containing wave-shaping sound chambers with approximately rectangular inlets and outlets of substantially the same size that are used to flatten or control the curvature of the acoustic wavefronts contained within system waveguides. Control of the degree of curvature of the wavefront enables the development of a wide variety of multi-waveguide arrays. The sound chambers are placed between a waveguides and a flattened conical horns of secondary waveguides. The sound chambers transform the curvature of the typical fan shaped wavefront that results from a conical horn throat into a wavefront that approximates a planar or curved rectangular ribbon of sound.

20 Claims, 7 Drawing Sheets

2
26
33
6
32
E
F
G
K
L
19
20
3
28
29
30

22'
2'
26'
6'
E'
F'
G'
K'
L'
3'
19'
20'
30'
29'
28'

WAVE SHAPING SOUND CHAMBER

CROSS REFERENCE TO RELATED APPLICATIONS

This application claims the benefit of United States Provisional Application 60/222,613 filed Aug. 2, 2000 in the name of the same inventor.

BACKGROUND OF THE INVENTION

1. Field of the Invention

This invention is generally directed to audio loudspeaker systems and more particularly to such systems, which incorporate sound chambers which transform fan shaped wavefronts issuing from primary waveguides into rectangular planar or curved wavefronts which are directed to sound disseminating secondary waveguides.

2. Description of the Related Art

Large sound systems contain multiple transducers operating in the same frequency band in order to achieve the required sound pressure level (SPL) and the required acoustical coverage of its intended target. The highest efficiency sound systems use the principle of horn loading to achieve maximum SPL. The horn and its associated driver have two particular characteristics of interest: the driver is by definition larger than the throat of the horn; and wavefronts are radiated in a generally spherical shape. The dimensional limit dictates that an array of such devices cannot be constructed so that the horn throats are in close proximity to one another; the throats are displaced by the size of the attached driver. The result of any multi-element combination is that of an array that generates multiple spherical sound waves with significant interference effects. The problems of the resulting multiple source array are well documented in the literature.

Significant effort has been invested by numerous practitioners of the audio arts to find solutions to this problem. The result has been great improvement in the understanding of the principle of horns and better control of the directional characteristics of such devices. D. B. Keele, Jr. has shown many ways to modify the directivity of horns through the use of flat sided conical growth sections combined with arbitrary adjustments to the walls of horns, "What's So Sacred about Exponential Horns?", D. B. Keele, Jr., Presented at the 51st Convention of the Audio Engineering Society, Los Angeles, May 1975, Preprint 1038. These horns became known as "constant directivity horns". None of the improvements of individual horns has resulted in an array of horns that eliminates the interference effects found in multi-source arrays.

This work was continued by Clifford A. Hendricksen and Mark S. Ureda with the goal of improved vertical directivity, "The Manta-Ray Horns", Clifford A. Hendricksen and Mark S. Ureda, Presented at the 58th Convention of the Audio Engineering Society, New York, November 1977, Revised June 1978. This was achieved through a vertically oriented, conical throat section and a constant angle between the top and bottom wall of the horn over most of its length. These horns were referred to as "constant directivity" and "Manta-Ray"horns.

Early Line Arrays

The line array results from a different approach to the problem of interference, H. F. Olson, *Acoustical Engineering,* (Van Nostrand, Princeton, N.J. 1957). In its simplest form, it is a row of closely spaced direct radiators operating in the same frequency band and is dependant on mutual coupling of one driver to the next. Drivers are said to be mutually coupled when they are placed within one wavelength of each other. The benefit of mutual coupling is that drivers operating under such conditions radiate their combined acoustical energy nearly as though they were a single transducer.

Until recently, line arrays have consisted of multiple small direct radiating transducers arranged in a vertical row. Typically the drivers are chosen to be sufficiently small to allow mutual coupling to the highest frequency of concern. For example four inch diameter drivers permit coupling to above 3 Khz, which is sufficient to allow good speech intelligibility. This approach yields a system with a controlled vertical coverage and correspondingly wide horizontal coverage but with at least two significant limitations. Such arrays of direct radiators are low in efficiency and the method does not work for typical horn loaded high frequency drivers because the wavelengths at the highest audio frequencies are generally a factor of ten shorter than the dimensions of the drivers used thus preventing mutual coupling. Furthermore, the use of small direct radiators severely restricts the operating bandwidth.

Waveguides with Linear Inlet Apertures

In October 1987 in New York City, Dr. Earl Geddes introduced the concept of an "Acoustic Waveguide", through the publication and presentation of a historically important technical paper at the 83rd Audio Engineering Society Convention. Many waveguides are described in the text of the paper with varying degrees of usefulness in the audio world. The publication is titled "Acoustic Waveguide Theory". The importance of this paper is that it prescribed and consolidated a new approach to the analysis of the boundary of the sound wave as it moves along the length of a horn. Specifically, it is noted that for any horn type device to be considered a true waveguide, it must meet the criteria that the wavefront will always intersect the boundary of the waveguide at a 90 degree angle. If this condition is not met, the wavefront cannot maintain contact with the wall of the horn and it thus should not be considered a waveguide. The reason for this is both obvious and simple. The particle motion in any wave is always in the direction of the travel of the wave and normal to the wavefront. Any boundary not normal to the wavefront will cause a reflection of energy, thus reducing contact with the waveguide wall.

The importance Geddes' work is emphasized by its selection from hundreds of papers for publication in the permanent record of the Journal of the Audio Engineering Society, two years later. (Preprint Number: 2547 Convention: 83 1987-10 AES Journal Vol:Issue: 37:7/8 Page: 555 Year: 1989). Three of the waveguides presented are of pivotal interest in the construction of a new type of line array because their throats approximate the shape of a narrow ribbon, either straight or curved. A characteristic of these waveguides is that they can be joined in an obvious manner to produce a waveguide of extended length. These three are derived from the coordinate systems after which they are named. The cylindrical waveguide is shown in FIGS. 6*a*–6*c,* the elliptic cylindrical waveguide is shown in FIGS. 5*a*–5*c* and the prolate spheroidal waveguide is shown in FIGS. 7*a*–7*c.*

A cylindrical waveguide can be configured of infinite length. A waveguide comprised of a number of segments of cylindrical waveguides joined at 90 degrees from the angle theta can also be of infinite length and results in an entrance or throat that is shaped as an extended rectangular slot. From Geddes we know that the height at the mouth must be the same as the height at the throat (i.e. that the two boundary surfaces are parallel) and that the wave is spread out only in the theta direction shown at FIGS. 5*a*, 6*a* and 7*a*. Geddes comments that all that remains to make this type of waveguide useful is the development of the necessary "phasing plug" to shape a sound wave to match the throat requirements of the waveguide.

The wavefront required to correctly propagate a cylindrical wave to the throat of the waveguide is cylindrical, (curved in the theta direction) and of the correct radius in order to propagate one parameter waves within the waveguide. Any wavefront other than a cylindrical wave of the correct radius will propagate down the waveguide through reflection and higher order modes that are quite undesirable according to Geddes. The compromise of the cylindrical waveguide is used in practice because it is extremely simple to fabricate since all waveguide surfaces are planar.

Geddes also discloses a waveguide suitable for use with a planar rectangular sound source. The elliptical cylindrical waveguide requires a planar wave of rectangular cross section at the throat. This waveguide can also be extended infinitely since two surfaces are parallel in the same manner as the cylindrical waveguide. At this time there is no evidence of any such waveguide in commercial production.

The prolate spheroidal waveguide approximates a section of a cylinder at the throat. This waveguide will exhibit good acoustical behavior if there is a limited growth in the theta direction. The side of this waveguide is a planar surface that is oriented radially from the apex of the waveguide. No two surfaces of the waveguide are parallel so an array of these waveguides cannot be infinite, but must have a finite radius and be thus limited. Several waveguides oriented in an arc will effectively form a single waveguide with a continuous throat approximating a curved ribbon. The prolate spheroidal waveguide was not developed further in this paper.

The First Wavefront Shaping Sound Chamber

In 1972 JBL of California introduced the 2405 high frequency transducer designed by Locanthi. The device controlled vertical directivity by producing a flat wavefront from a vertical slot. This was achieved by enclosing an inner body of circular cross section with flattened sides within an outer shell, thus forming an acoustic conduit with an inlet aperture that is adapted to the transducer and an outlet aperture that is planar and rectangular. The path lengths as measured from the diaphragm to the outlet aperture are practically identical. The wavefront that emerges is rectangular and planar. This sound chamber is suitable for use with some of Geddes' waveguides.

New Line Arrays

The mathematical model for the cylindrical waveguide is evident in a commercial loudspeaker system sold under the trade name of "V-DOSC" produced by L-Acoustics of France. The wavefront emerging from this waveguide is said to be cylindrical. The required phasing plug mentioned by Geddes has been developed by Heil and is disclosed by Christian Heil in U.S. Pat. No. 5,163,167 and in French Patent 2,627,886. It takes the shape of a sound chamber capable of transforming the circular planar wavefront at the exit of a high frequency compression driver into a rectangular planar isophase wavefront suitable for use with the elliptical cylindrical waveguide. The device disclosed by Heil produces, according to its author, a planar wavefront that does not meet the requirement of a cylindrical waveguide.

Adamson discloses waveguides in U.S. Pat. No. 5,900,593 that are modified from the prolate spheroidal type of waveguide to create a throat that approximates a curved slot and is wide enough to accommodate the requirements of particular sound chambers. Adamson also discloses sound chambers capable of transforming a planar circular wavefront into that of a section of a cylinder or a curved ribbon. The wavefront emerging from this type of waveguide is like the outer surface of a torus, i.e. the outer surface of a donut, or a bent tube.

In both the Heil and the Adamson sound chambers, when the wavefront is considered in two orthonormal planes it can be seen that the wavefront is forced to expand in one plane and not in the other. In the plane taken as a section in the axial direction across the smaller dimension of the sound chamber, the dimension the passageways within does not expand. However, in the axial plane orthonormal to the first plane considered, the expansion of the sound chamber is large. This is necessary so that the rectangular ribbon of sound thus created is equal to or greater than the outside dimension of the audio transducer that energizes the sound chamber. This method allows the formation of a continuous sound source notwithstanding the dimension of the transducer.

A very important limitation of the Adamson and the Heil devices is that there is significant required boundary divergence in order to achieve the required length at the exit aperture. In the half of the sound chamber closest to the inlet, the sound wave propagates with an expanding annular shaped wavefront. As the wavefront nears the exit of the sound chamber, the wavefront shape changes toward its target shape, that of a planar rectangle.

It is a well documented fact that a planar wave cannot propagate in an enclosed space unless the boundaries of the space are parallel. As the wave nears the exit, the diverging upper and lower walls of these sound chambers cause significant reflections. The disturbance in the wavefront caused by these reflections results in a chaotic behavior above 8 Khz. This behavior is in particular apparent over nearly 30% of the total area of the exit. This results in an obvious and measurable deterioration in the summation of the wavefronts of adjacent sound chambers, particularly at the highest frequencies.

SUMMARY OF THE INVENTION

The present invention is embodied in a plurality of loudspeakers arranged in a horizontal or vertical array, where each loudspeaker is comprised of at least one high frequency compression driver, at least one primary waveguide and at least one wave-shaping sound chamber and at least one secondary waveguide. In the preferred embodiment of present invention, the primary waveguide takes the approximate form of a constant directivity horn throat that can be characterized as a hollow wedge shaped acoustic conduit, wherein the inlet aperture is so shaped to be affixed to the outlet of an acoustic transducer. The outlet aperture is substantially rectangular and so shaped to be affixed to the wave-shaping sound chamber and the sides of the primary waveguide are substantially straight. There are other forms of horn throat that will result in a different distribution of sound in the horn throat.

In the present invention a high frequency compression driver affixed to the primary waveguide generates an acoustic wavefront that changes shape from a circular planar wave to that of a curved ribbon as it expands along the length of the primary waveguide. The sound waves are permitted to follow their natural behavior by expanding unimpeded as a fan shaped wave. This allows the wave to expand while maintaining a 90 degree angle between the wavefront and the side wall of the horn throat. A sound wave originating from the sound source will propagate along the length of the conduit in the form of an arc shape, the angle of which will be proportional to the included angle of the side walls of the primary waveguide. The horn throat is terminated at a point where the straight line dimension of the arc from end to end is approximately equal to the desired total length of the required wavefront. The resulting outlet aperture is rectangular.

The wavefront shaping sound chamber is so formed that its inlet aperture matches the shape of the outlet aperture of the horn throat. The outlet aperture of the sound chamber is similar in size and shape to the inlet aperture. The sound chamber is comprised of two outer shells halves that define the inlet and outlet aperture and form an inner cavity having opposing inner surfaces. Contained within the inner cavity is an inner body that has an outer surface that together with the inner surfaces defines at least one passageway that connects the inlet aperture to the outlet aperture. The sound chamber is so formed to provide means to attach the inlet aperture of the sound chamber to the outlet aperture of the primary waveguide and to provide means to attach its outlet aperture to the inlet aperture of the secondary waveguide.

An alternate embodiment of the present invention is to form the outer shell of the sound chamber and the primary waveguide as one inseparable unit or the sound chamber and primary and secondary waveguides as a single unit.

The inner surface of the outer shells and the outer surface of the inner body are so formed that the passageway permits a plurality of acoustic paths from the inlet aperture to the outlet aperture. The inner surfaces of the outer shell and the outer surface of the inner body are so formed that the plurality of acoustic paths that connect the inlet aperture to the outlet aperture are unequal in length.

The primary means of controlling the path lengths through the sound chamber is to increase the thickness of the inner body and to correspondingly increase the outer shell so that the portion of the sound wave that encounters this sectional shape must travel further than that portion of the sound wave that encounters a thinner shaped section of the inner body.

The sound wave that arrives at the inlet aperture is arc shaped and so the mid point of the arc is advanced to the furthest point of the horn throat and thus arrives at an earlier time than the sound at the edge of the wavefront. At each point across the width of the inlet aperture of the wave shaping sound chamber, the wavefront arrives at a different time. A different section of inner body and outer shell is thus shaped and presented to the incoming sound wave at each point where a different path length is required.

The plurality of paths that extend through the sound chamber may be so shaped that the length of the paths causes the advanced portions of the wave to take a correspondingly longer path through the sound chamber corresponding to the difference between the shape of the incoming wavefront and the required outlet wavefront. The result is that the wavefront emerges with the curvature of the wavefront reduced or completely flattened.

Since the curvature of the wavefront in the horn throat is independent of the degree of path length difference across the width of the sound chamber, any amount of curvature is achievable. For example, the path lengths through the sound chamber could be increased at the ends of the aperture and made shorter in the middle with the result that the curvature of the wavefront would be increased.

A concave wavefront can also be created by increasing the path lengths through the mid portion sound chamber to a greater degree than that required to flatten the wavefront.

A further aspect of the present invention is that nearly all the energy contained in the arc shaped wavefront that arrives at the inlet of the wave-shaping sound chamber is diverging from the center axis of said chamber. Since the particle motion in the curved wave is normal to the wavefront, only the particle motion in the exact center of the wavefront in moving in the axial direction of the device. Since the wavefront will emerge from the waveshaping sound chamber with a different radius or as a planar wavefront, it is necessary to re-direct the particle movement in the wavefront.

It is a function of the present invention to provide means to redirect the energy in the wavefront by means of dividing the plurality of paths within the sound chamber with vanes that extend from the inlet aperture to the outlet aperture, oriented normal to the wavefront and radially from the apex of the arc of the exit wavefront. The space between the vanes must be less than or equal to one wavelength of the highest frequency that will be properly transmitted by the sound chamber. This dimensional constraint will insure that no energy can be reflected laterally between the vanes.

With the vanes correctly oriented in the entrance of the sound chamber, the expanding arc shaped wavefront will enter between the vanes without reflection from the substantially parallel end walls of the sound chamber. The resulting variety of wavefronts that can be created by this method meet the requirements for certain useful waveguides. In particular, the prolate spheroidal, the elliptical cylindrical and to a lesser degree, the cylindrical waveguides (after Geddes) may be fixed to the outlet aperture to form a complete sound transmission device.

This type of structure may be combined with the co-entrant mid device described in Adamson patent application Ser. No. 09/359,766 of July 1999 or may be applied in the manner of the V-DOSC system of Heil.

In the present invention there are no differences in principle or geometry between a horizontal array and a vertical array. The horizontal array is a simple 90 degree transformation of the vertical array and vice versa. Depending on the desired application, various embodiments may be constructed and oriented in any desired angle to suit the desired application.

It is an object of the present invention is to provide means to modify the curvature of an entire acoustic wavefront emanating from a typical horn throat and to provide a suitable outlet aperture and a wavefront of a suitable degree of flatness to satisfy the requirements of all possible waveguides that have throats characterized by an extended slot.

It is a further object of the present invention to provide a method that allows more than one transducer operating in the same frequency range to produce a common wavefront with virtually zero acoustical interference.

BRIEF DESCRIPTION OF DRAWINGS

A better understanding of the invention will be had with reference to the attached drawings wherein.

DESCRIPTION OF THE PREFERRED EMBODIMENTS

Figure 1:
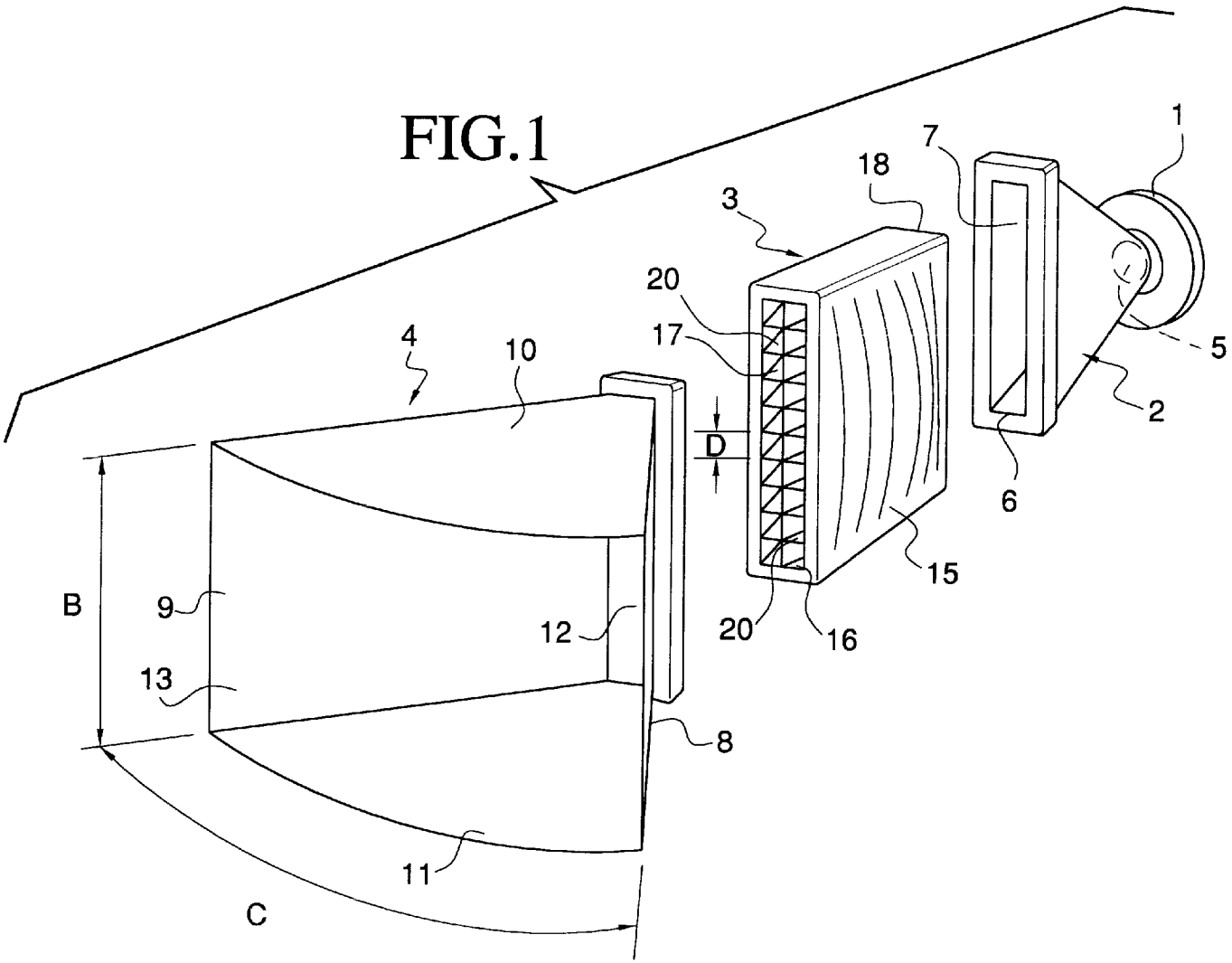
FIG. 1 is an assembly view of a primary waveguide with acoustic transducer, a wave shaping sound chamber and a secondary waveguide of the invention.

With reference to FIG. 1., the present invention includes an acoustic transducer 1, a primary waveguide shown in the form of a simple horn 2, a wave shaping sound chamber 3 and a secondary waveguide 4. The primary waveguide 2 comprises an inlet aperture 5 and an outlet aperture 6 that are connected by an expanding wedge shaped acoustic conduit 7.

The secondary waveguide 4 comprises sidewalls 8 and 9, and upper and lower walls 10 and 11 that define the desired properties of the sound wave that will be transmitted by the waveguide. The secondary waveguide also includes an inlet aperture 12 and an outlet aperture or mouth 13.

The wave shaping sound chamber 3 comprises an outer shell 15 and an inner body 16 forming a conduit 17 for the transmission and shaping of a sound wave and also includes an inlet aperture 18 and an outlet aperture 19. For best performance vanes 20 are placed within the sound chamber spaced at a distance "D" with respect to one another and which distance is within one wavelength of the highest frequency to be transmitted by the sound chamber in order to prevent lateral reflections within the passageways between the vanes.

The outlet aperture 6 of the primary waveguide 1 is so formed to match the size and shape of the inlet aperture 18 of the sound chamber 3. The outlet aperture 19 of the sound chamber 13 is so formed to match the size and shape of the inlet aperture 12 of the secondary waveguide 4. The walls 8 and 9 of the secondary waveguide 4 are typically outwardly diverging and define the acoustic coverage pattern in the angular dimension "C" and the walls 10 and 11 typically form a smaller included angle or may be parallel in the angular dimension "B". Where the angular dimension "B" is zero, the waveguide may conform to the mathematical definition of a cylindrical or an elliptical cylindrical waveguide and where the angular dimension "B" is greater than zero, the waveguide may conform to the mathematical definition of a prolate spheroidal waveguide.

Where the angular dimension "B" is greater than zero, for best performance, the inlet aperture 12 of the secondary waveguide 4 and the outlet aperture 19 of the sound chamber 3 may be curved in an arc segment of an included angle that corresponds to the included angle of the walls 10 and 11.

Figure 2B:
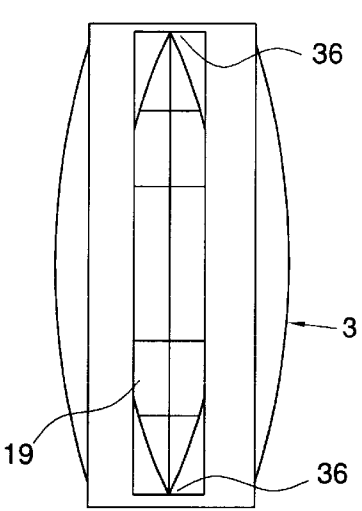
FIG. 2*b* is a front elevational view of the wave shaping sound chamber of FIG. 2*a;*
Figure 2C:
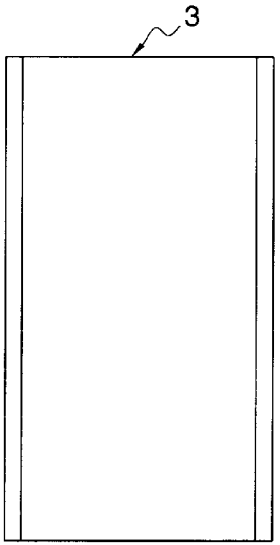
FIG. 2*c* is a side view of the wave shaping sound chamber of FIG. 2*a;*
Figure 2A:
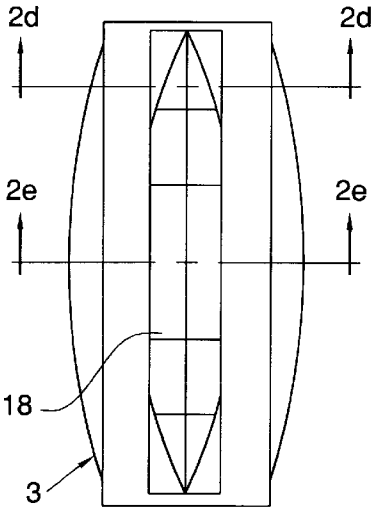
FIG. 2*a* is a rear elevational view of a wave shaping sound chamber for creating a flat outlet wave.
Figure 2E:
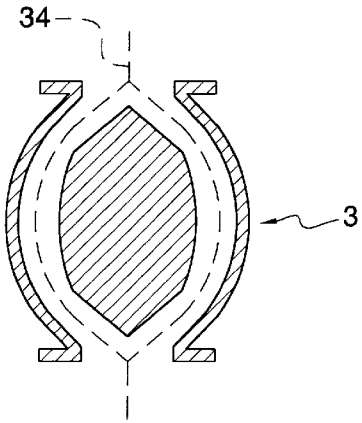
FIG. 2*e* is a cross-sectional view, on a reduced scale, taken along line 2*e*—2*e* of FIG. 2*a* showing an acoustic path length in dotted line.
Figure 2D:
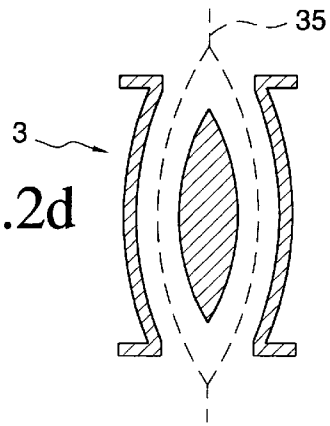
FIG. 2*d* is a cross-sectional view, in a reduced scale, taken along line 2*d*–*d* of FIG. 2*a* showing an acoustic path length in dotted line.

In FIGS. 2*a*–2*c* the sound chamber 3 that is suitable for the propagation of a flat wavefront from the outlet aperture 19, is shown from the back, side, and front. It can be seen that the inlet aperture 18 and the outlet aperture 19 are the same size and shape. It can also be seen that the acoustic path length, shown by the dashed line 34 in FIG. 2*e*, from the inlet to the outlet is longer than the acoustic path length 35 from the inlet to the outlet in section in FIG. 2*d*. Precise and predictable variations in path length can be produced by varying the shape of the outer surface of the of the inner body and inner surface of the outer shell.

The sound chamber should be constructed with an acoustic path as short as possible at the outer edge 36, see FIG. 2*b* of the chamber 3. The increase in the length of acoustic path 34 over the acoustic path at the extreme edge 36 of the sound chamber 3 must be equal to the time difference between the time when the leading edge at the center of a curved wavefront 32, see FIG. 4*a*, enters the sound chamber and the time when the outer edge 33 enters the sound chamber. When this relationship is established the wavefront will emerge from the outlet aperture 19 of the sound chamber substantially flat as shown in FIG. 4*a*.

Figure 3B:
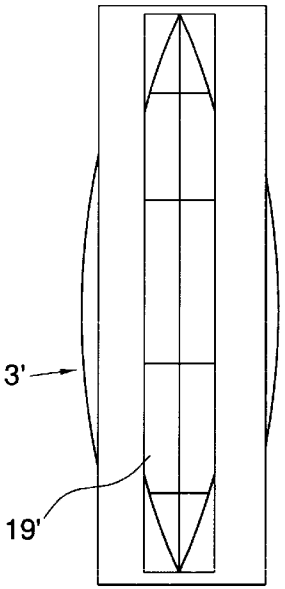
FIG. 3*b* is a front elevational view of the wave shaping sound chamber of FIG. 3*a;*
Figure 3C:
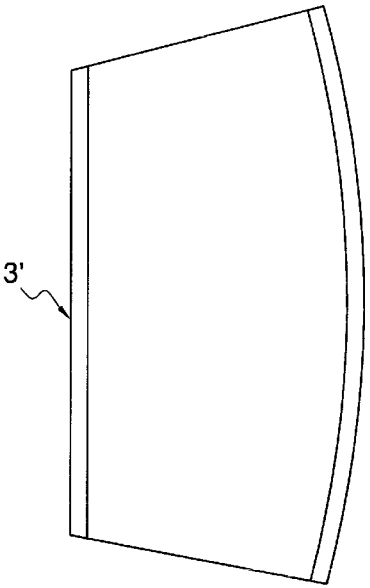
FIG. 3*c* is a side view of the wave shaping sound chamber of FIG. 3*a;*
Figure 3A:
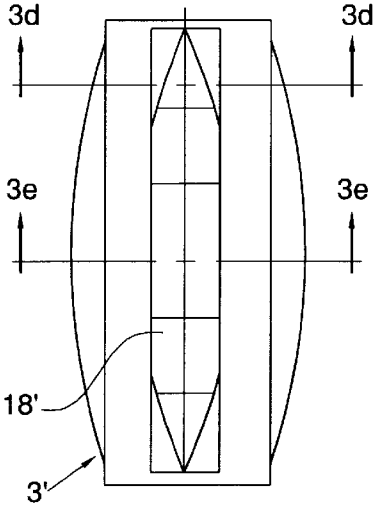
FIG. 3*a* is a rear elevational view of another embodiment of wave shaping sound chamber for creating a curved outlet wave.

In FIGS. 3*a*–3*c* the sound chamber 3' that is suitable for the propagation of a curved wavefront from the outlet aperture 19' is shown from the back, front and side. It can be seen that the inlet aperture 18' and the outlet aperture 19' are the same shape but not the same length due to the expansion in the width of the acoustic passageway. It can also be seen that the acoustic path length 37 from the inlet to the outlet in section 3*e*—3*e* is longer than the acoustic path length 38 from the inlet to the outlet in section 3*d*—3*d*.

Figures 4A, 4B:
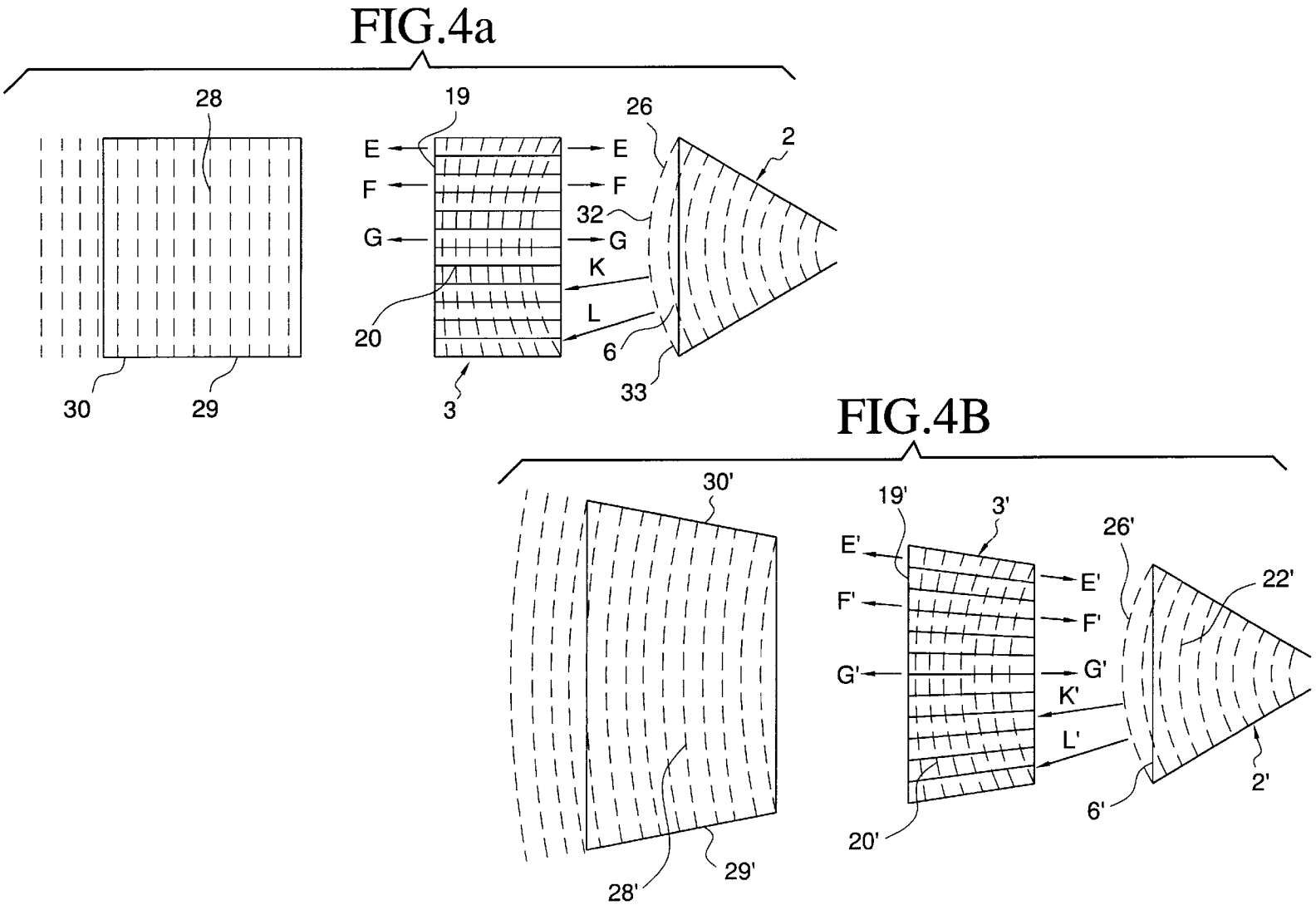
FIG. 4*a* is a schematic illustration of the primary waveguide, the sound chamber and the secondary waveguide showing the transformation of sound waves from a curved wavefront to a flat wavefront.
FIG. 4*b* is a schematic illustration of the primary waveguide, the sound chamber and the secondary waveguide showing the transformation of sound waves from a curved wavefront to a wavefront with a reduced radius.

In FIG. 4*a* the expansion of the curved wavefront 22 within the primary waveguide 2 is shown. At the outlet aperture 6 the curvature 23 of the wavefront is significant. The curved wavefront contains substantial energy components indicated by the arrows "K" and "L" that are diverging from the center of the sound wave 26. When this diverging acoustic energy encounters the plurality of vanes 20, the sound wave is compelled to move through the sound chamber in a manner that is parallel with the vanes. From the sections in FIGS. 2*d* and 2*e* it can be seen that the acoustic passageway through the center of the sound chamber is longest and that the length of the passageway becomes increasingly shorter toward the outer ends 36 of the sound chamber.

In the schematic of FIG. 4*a* the arrows E—E, F—F and G—G represent possible sound paths through the sound chamber. A sound wave traveling the path G—G will take longer to travel through the sound chamber than sound traveling on the path F—F, which in turn will take longer than sound traveling on the path E—E. When the time delays thus created are inversely proportional to the time lag in the corresponding parts of the wave when compared to the leading edge at the center of the wave 26, then the wavefront emerging from the outlet aperture 19 is substantially flat. The wavefront 28 can then be successfully transmitted without interference within a secondary waveguide 29 that has parallel side walls or boundaries 30 at the ends of the wavefront. This is possible because the wavefront intersects the waveguide boundaries at right angles.

In FIG. 4*b* the expansion of the curved wavefront 22' within the primary waveguide 2' is shown. At the outlet aperture 6' the curvature 23' of the wavefront is significant. The curved wavefront contains substantial energy components indicated by the arrows K' and L' that are diverging from the center of the sound wave 26'. When this diverging acoustic energy encounters the plurality of vanes 20' the sound waves are compelled to move through the sound chamber in a manner that is parallel with the vanes.

Figure 3E:
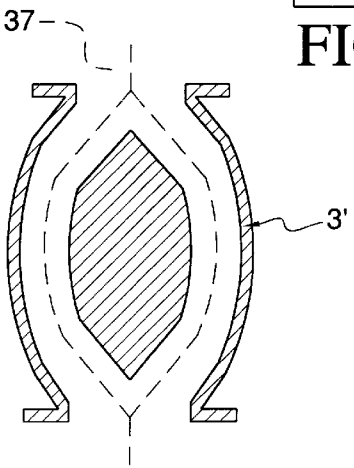
FIG. 3*e* is a cross-sectional view, in a reduced scale, taken along lines 3*e*—3*e* of FIG. 3*a* showing an acoustic path length in dotted line.
Figure 3D:
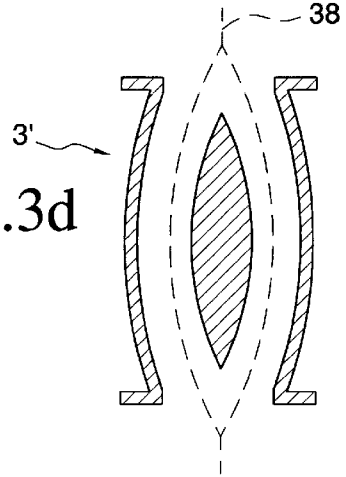
FIG. 3*d* is a cross-sectional view, on a reduced scale, taken along lines 3*d*—3*d* of FIG. 3*a* showing an acoustic path length in dotted line.

From the sections in FIGS. 3*d* and 3*e* it can be seen that the acoustic passageway 37 through the center of the sound chamber is longest and that the length of the passageway 38 becomes increasingly shorter toward the outer ends of the sound chamber. However it is shown that the acoustic passageway 37 through Section 3*e*—3*e* is not as long as the acoustic passageway 34 shown in FIG. 2*e* through section 2*e*—2*e*.

In the schematic of FIG. 4*b*, the arrows E'—E', F'—F' and G'—G' represent possible sound paths through the sound chamber 31. A sound wave traveling the path G'—G' will take longer to travel through the sound chamber than sound traveling on the path F'—F', which in turn will take longer than sound traveling on the path E'—E'. When the passageways thus created are somewhat less than that which is inversely proportional to the time lag in the corresponding parts of the wave when compared to the leading edge at the center of the wave 26', then the wavefront emerging from the outlet aperture 19' has less curvature than the wavefront at the inlet aperture 18'. The wavefront 28' can then be successfully transmitted without interference within a secondary waveguide 29' that has diverging boundaries 30' at the ends of the wavefront. This is possible because the wavefront intersects the waveguide boundaries or walls at right angles.

The primary means of controlling the path lengths through the sound chamber is to increase the thickness of the inner body and to correspondingly increase the outer shell so that the portion of the sound wave that encounters this sectional shape must travel further than that portion of the sound wave that encounters a thinner shaped section of the inner body.

The sound wave that arrives at the inlet aperture is arc shaped and so the mid point of the arc is advanced to the furthest point of the horn throat and thus arrives at an earlier time than the sound at the edge of the wavefront. At each point across the width of the inlet aperture of the wave shaping sound chamber, the wavefront arrives at a different time. A different section of inner body and outer shell is thus shaped and presented to the incoming sound wave at each point where a different path length is required.

Figure 5:
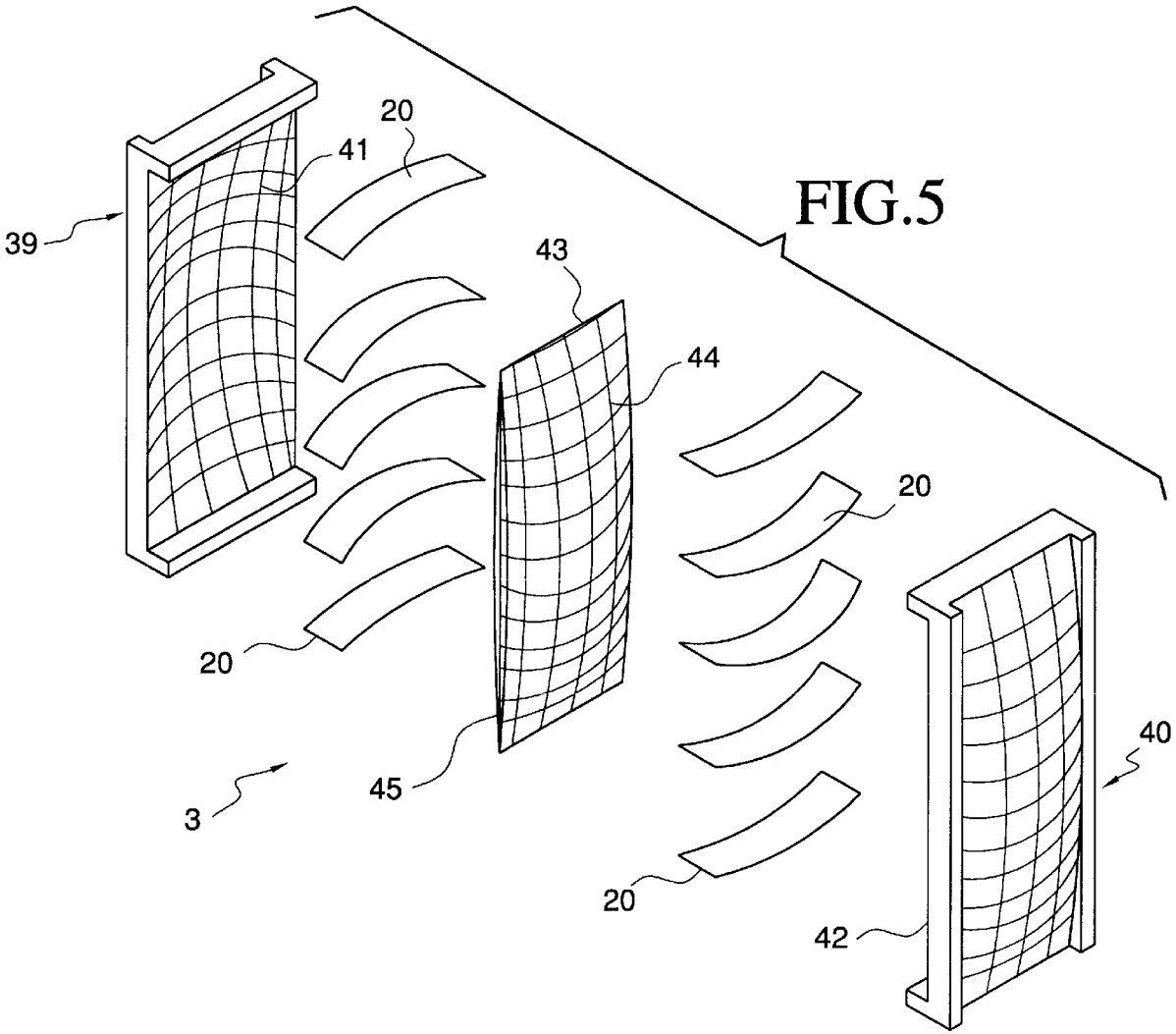
FIG. 5 is an exploded view of the wave shaping sound chamber showing the inner body and the outer shell.
Figure 7A:
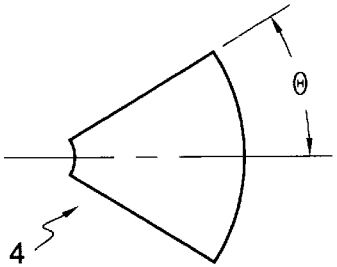
FIG. 7*a* is a top plan view, on reduced scale, of an cylindrical secondary waveguide of the prior art which may be used with the invention.
Figure 7B:
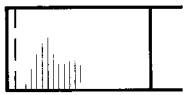
FIG. 7*b* is a right side view of the secondary waveguide of FIG. 7*a;*
Figure 7C:
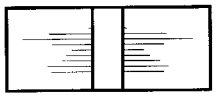
FIG. 7*c* is a front elevational view of the secondary waveguide of FIG. 7*a;*

FIG. 5 shows the wave-shaping sound chamber 3 exploded. The sound chamber is comprised of two outer shells 39 and 40, at least one inner body 43, inner surfaces of the outer shell 41 and 42, outer surfaces of the inner body 44 and 45 and a plurality of vanes 20. The two outer shells 39 and 40 are substantially the same. The inner surfaces of the outer shells 41 and 42 are approximately an inverted form of the outer surfaces of the inner body 43 and 44.

Figure 6A:
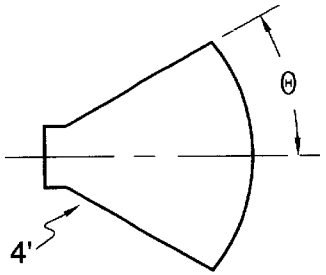
FIG. 6*a* is a top plan view, on reduced scale, of an elliptical cylindrical secondary waveguide of the prior art which may be used with the invention.
Figure 6B:
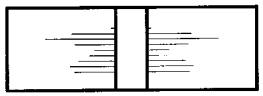
FIG. 6*b* is a right side view of the secondary waveguide of FIG. 6*a;*
Figure 6C:
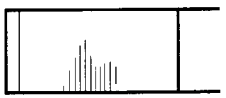
FIG. 6*c* is a front elevational view of the secondary waveguide of FIG. 6*a;*

FIGS. 6*a*–6*c* show alternate embodiments 4, 4' and 4" of secondary waveguides which are configured as conventional waveguides as described by Geddes. Waveguide 4' is the elliptical cylindrical waveguide, waveguide 4 is a cylindrical waveguide and waveguide 4" is the prolate spheroidal waveguide. Any of the waveguide configurations may be used as the secondary waveguide of the invention.

Figure 8A:
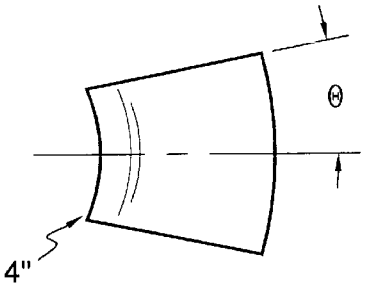
FIG. 8*a* is a top plan view, on reduced scale, of a prolate spheroidal secondary waveguide of the prior art which may be used with the invention.
Figure 8B:
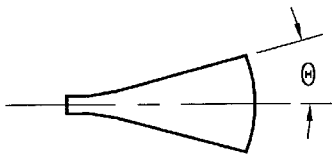
FIG. 8*b* is a right side view of the secondary waveguide of FIG. 8*a;*
Figure 8C:
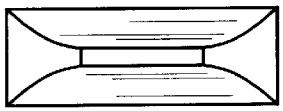
FIG. 8*c* is a front elevational view of the secondary waveguide of FIG. 8*a*.
Figure 9:
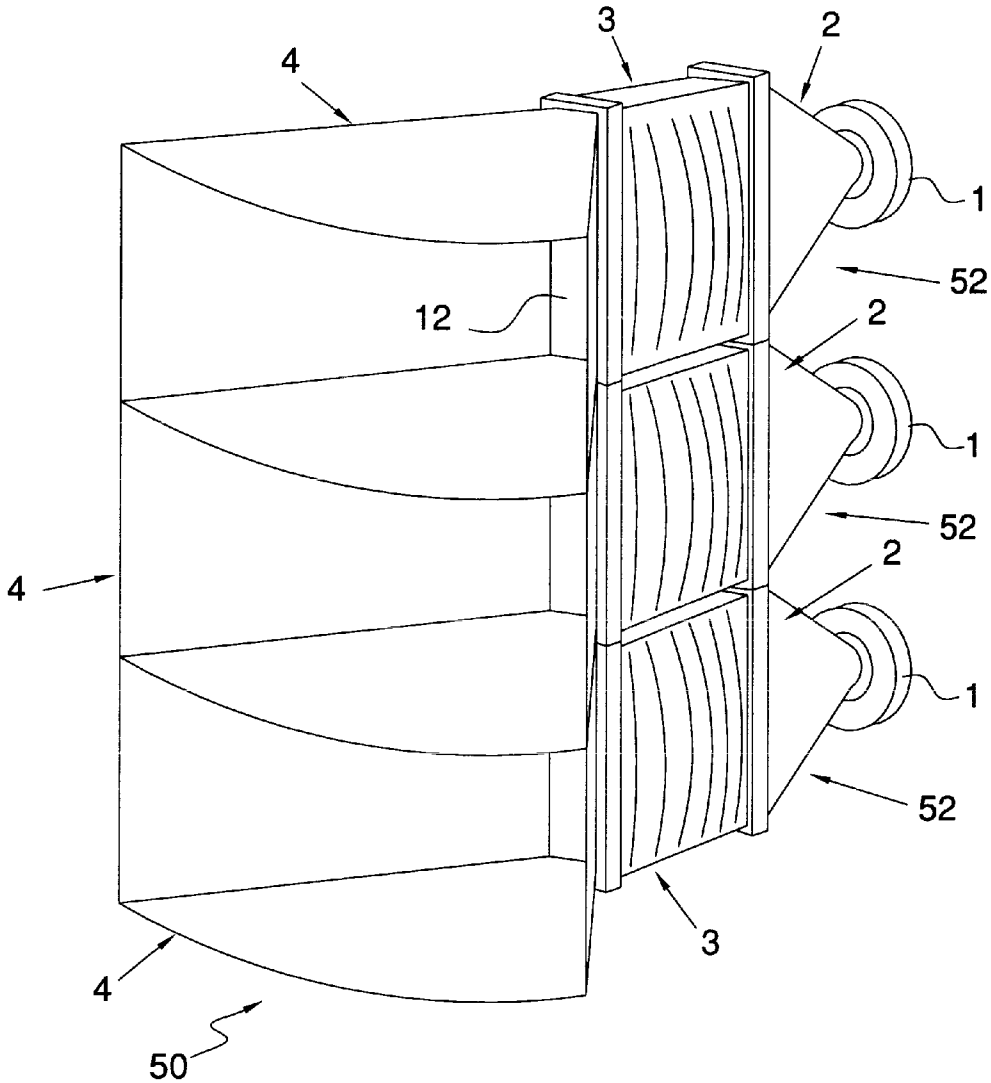
FIG. 9 is a front perspective view of an array of loudspeakers in accordance with the invention.

FIG. 8 shows an array of three 50 complete loudspeakers 52 and demonstrates the close coupling that can be achieved with this invention. Shown are the transducers 1, the primary waveguides 2, the sound chambers 3, the secondary waveguides 4 and the inlet and outlet apertures 12 and 13 of the secondary waveguides.

I claim:

1. A sound chamber having a substantially rectangular shaped inlet aperture, a substantially rectangular shaped outlet aperture and an axis extending from a center of the inlet aperture to a center of the outlet aperture, for the purpose receiving a sound wave in said inlet aperture from a sound source and transmitting the sound wave from said outlet aperture, the sound wave having a wavefront which is curved in a longer dimension of said inlet aperture, said sound chamber defining interiorly a predefined acoustic conduit including a plurality of acoustic paths connecting said inlet aperture to said outlet aperture, wherein said plurality of acoustic paths are not all equal in length but are so defined that the sound wavefront transmitted from said outlet aperture has a different degree of curvature in the longer dimension of said outlet aperture than a curvature in said longer dimension of the wavefront received at said inlet aperture.

2. A sound chamber according to claim 1 wherein the longer dimension of the inlet aperture and the longer dimension of the outlet aperture are substantially equal in length and the plurality of acoustic paths are so defined that the sound wavefront transmitted from the outlet aperture is flat.

3. A sound chamber according to claim 1 wherein the longer dimension of the inlet aperture and the longer dimension of the outlet aperture are substantially equal in length and the plurality of acoustic paths are so defined that the sound wavefront transmitted from the outlet aperture is curved in the long dimension of the outlet aperture, the curvature being outward from said outlet aperture.

4. A sound chamber according to claim 1 wherein the longer dimension of the outlet aperture is greater than the longer dimension of the inlet aperture and the plurality of acoustic paths within said acoustic conduit are so defined that the sound wavefront transmitted from the outlet aperture is curved in the long dimension of the outlet aperture, said curvature being outward from said outlet aperture.

5. A sound chamber according to claim 1 wherein the longer dimension of the outlet aperture is greater than the longer dimension of the inlet aperture and the plurality of acoustic paths within said acoustic conduit are so defined that the sound wavefront transmitted from the outlet aperture is flat.

6. A sound chamber according to claims 1 through 5 wherein a plurality of vanes divide the acoustic conduit into said plurality of acoustic paths.

7. A sound chamber according to claim 6 wherein a distance between the vanes is less than or equal to one wavelength of a highest audio frequency to be transmitted.

8. A sound chamber comprising an outer shell and an inner body, said outer shell comprising a substantially rectangular shaped inlet aperture and a substantially rectangular shaped outlet aperture and opposing inner surfaces, said inner body being placed within said outer shell, said inner body having an outer surface, said inner opposing surfaces and said outer surface defining a predetermined space defining an acoustic conduit, said conduit defining a plurality of separated acoustic paths connecting said inlet aperture to said outlet aperture wherein said plurality of acoustic paths are not all equal in length.

9. A sound chamber according to claim 8 wherein a longer dimension of the inlet aperture and a longer dimension of the outlet aperture are substantially equal in length and the plurality of acoustic paths are so defined that a sound wavefront transmitted from the outlet aperture is flat.

10. A sound chamber according to claim 8 wherein a longer dimension of the inlet aperture and a longer dimension of the outlet aperture are substantially equal in length and the plurality of acoustic paths are so defined that the sound wavefront transmitted from the outlet aperture is curved in the long dimension of the outlet aperture, and said curvature being outward from said outlet aperture.

11. A sound chamber according to claim 8 wherein a longer dimension of the outlet aperture is greater than a longer dimension of the inlet aperture and the plurality of acoustic paths are so defined that the sound wavefront transmitted from the outlet aperture is flat.

12. A sound chamber according to claim 8 wherein a longer dimension of the outlet aperture is greater than a longer dimension of the inlet aperture and the plurality of acoustic paths are so defined that the sound wavefront transmitted from the outlet aperture is curved in the long dimension of the outlet aperture, and said curvature being outward from said outlet aperture.

13. A sound chamber according to claim 8 wherein a longer dimension of the outlet aperture is greater than a longer dimension of the inlet aperture and the plurality of acoustic paths are so defined that the sound wavefront transmitted from the outlet aperture is curved in the long dimension of the outlet aperture, and said curvature being outward from said outlet aperture.

14. A sound chamber according to any one of claims 9 through 13 wherein a plurality of vanes divide the acoustic conduit into said plurality of acoustic paths.

15. A sound chamber according to claim 14 wherein a distance between the vanes is less than or equal to one wavelength of a highest audio frequency to be transmitted.

16. A loudspeaker comprising an acoustic transducer, a primary waveguide, a sound chamber and a secondary waveguide, said primary waveguide comprising a wedge shaped acoustic conduit, having an entrance adapted to said acoustic transducer and an exit which is substantially rectangular shaped, said sound chamber having a substantially rectangular shaped inlet aperture and a substantially rectangular shaped outlet aperture, said inlet aperture adapted in size and shape to be affixed to said outlet aperture of said primary waveguide for purpose of receiving a sound wave from said primary waveguide and transmitting a sound wave from said inlet aperture to said outlet aperture, said sound wave having a wavefront, said wavefront being curved in a longer dimension of said inlet aperture, said sound chamber including a predefined acoustic conduit defining a plurality of separately spaced acoustic paths connecting said inlet aperture to said outlet aperture, wherein the plurality of acoustic paths are not all equal in length but are so defined that the sound wavefront transmitted from said outlet aperture has a different degree of curvature in a longer dimension of said outlet aperture than a curvature in said longer dimension of the wavefront received at said inlet aperture, said secondary waveguide including a wedge shaped acoustic conduit having an inlet aperture adapted to the shape of the outlet aperture of the sound chamber and having walls and an outlet aperture, and said walls expanding the sectional area of said secondary waveguide from said inlet aperture to the outlet aperture thereof at such angles as are required to control and direct the transmitted sound wave.

17. A loudspeaker according to claim 16 wherein the secondary waveguide is a cylindrical waveguide.

18. A loudspeaker according to claim 16 wherein the secondary waveguide is an elliptical cylindrical waveguide.

19. A loudspeaker according to claim 16 wherein the secondary waveguide is a prolate spheroidal waveguide.

20. A sound chamber comprising an outer shell and an inner body and having a center portion and outer end portions, said outer shell comprising a substantially rectangular shaped inlet aperture and a substantially rectangular shaped outlet aperture and opposing inner surfaces, said inner body being placed within said outer shell, said inner body having an outer surface, said inner opposing surfaces and said outer surface defining a predetermined space defining an acoustic conduit, said conduit defining a plurality of acoustic paths connecting said inlet aperture to said outlet aperture wherein said plurality of acoustic paths are not all equal in length and wherein the acoustic paths are shorter adjacent said outer end portions of the sound chamber than through said central portion of the sound chamber.

* * * * *